US011110621B2

(12) United States Patent
Palmieri

(10) Patent No.: US 11,110,621 B2
(45) Date of Patent: Sep. 7, 2021

(54) HAIR CUTTING DEVICE

(71) Applicant: Drake S.r.l., Vicenza (IT)

(72) Inventor: Giuseppe Palmieri, Monticello Conte Otto (IT)

(73) Assignee: SAFE—S.R.L., Monticello Conte Otto (IT)

( * ) Notice: Subject to any disclaimer, the term of this patent is extended or adjusted under 35 U.S.C. 154(b) by 64 days.

(21) Appl. No.: 16/341,897

(22) PCT Filed: Oct. 10, 2017

(86) PCT No.: PCT/IB2017/056261
§ 371 (c)(1),
(2) Date: Apr. 13, 2019

(87) PCT Pub. No.: WO2018/073693
PCT Pub. Date: Apr. 26, 2018

(65) Prior Publication Data

US 2019/0240854 A1 Aug. 8, 2019

(30) Foreign Application Priority Data

Oct. 18, 2016 (IT) ..... 102016000104493

(51) Int. Cl.
*B26B 21/56* (2006.01)
*B26B 21/42* (2006.01)

(52) U.S. Cl.
CPC ..... *B26B 21/56* (2013.01); *B26B 21/42* (2013.01); *B26B 21/565* (2013.01)

(58) Field of Classification Search
CPC ..... B26B 21/56; B26B 21/42; B26B 21/565
See application file for complete search history.

(56) References Cited

U.S. PATENT DOCUMENTS

| | | | | |
|---|---|---|---|---|
| 1,069,831 | A | 8/1913 | Traylor | |
| 1,961,132 | A | 6/1934 | Behrman | |
| 2008/0104847 | A1* | 5/2008 | Veras | B26B 21/10 30/49 |
| 2009/0183376 | A1* | 7/2009 | Wang | B26B 21/12 30/233.5 |
| 2011/0130678 | A1* | 6/2011 | Williamson, IV | A61B 17/3205 600/564 |
| 2018/0354147 | A1* | 12/2018 | Goldfarb | B26B 21/4056 |

FOREIGN PATENT DOCUMENTS

| | | |
|---|---|---|
| CN | 2230650 | 7/1996 |
| CN | 1426345 | 6/2003 |
| DE | 29914680 | 8/2000 |
| DE | 202008006860 | 8/2008 |

* cited by examiner

*Primary Examiner* — Omar Flores Sanchez
(74) *Attorney, Agent, or Firm* — Themis Law

(57) ABSTRACT

A hair cutting tool includes a shaped supporting body for a handle and having a gripping element for laminar bodies; a cutting blade having a laminar body provided with a single bevel and a cutting edge defining a concave development line toward the inside of the laminar body.

4 Claims, 1 Drawing Sheet

HAIR CUTTING DEVICE

FIELD OF APPLICATION

The present invention is applicable to the hair cutting field and, in particular, relates to a hair cutting tool.

More in detail, the present invention relates to a hair cutting tool provided with a shaped cutting blade.

STATE OF THE ART

The field of the cutting blades is particularly varied for the shape with which they are made. In fact, blades with straight and single bevel, similar to a chisel, or double bevel cutting wire. Blades with shaped cutting wire, typically convex or mixtilinear, for particular purposes are also known.

Typically, the blades have a flat body. However, there are also known blades with rounded body such as gauges, i.e. blades which, besides the rounded body, have a convex shaped cutting wire.

Blades are often used also in combination with each other such as in the case of scissors.

All the above described types have been designed to fulfil particular functions. Therefore, in other words, what distinguishes a blade from the others is the needed cutting type.

An example consists of a particular type of hair cutting scissors whose blades are comb shaped to allow a trimming of the hair itself.

However, the very scope of the cutting hair has many problems that need to be solved with specific hair cutting tools. In cutting hair, in fact, the cutting direction and the cutting type not only allow to give a particular shape to the overall combing, but also to give more or less fade effects to make the cutting as regular as possible.

In addition, the hair cutting is a particularly delicate operation as the hair may be ruined, damaged, or predisposed to the growth of split ends or the like.

Typically, scissors and razors are used for hair cutting, and the various effects are obtained by maneuvering both tools. Scissors, for example, would only allow a sharp and straight cut. On the contrary, to get specific shades, they are used vertically and gripping the V-blades. This allows to guide the lock towards the cutting wire and make a fade cutting from the outside towards the center.

However, such technique does not allow the execution of smooth shades as they tend to give the lock a pointed and serrated shaping.

The use of razors also allows the locks to be shaded in different directions. However, also in this case the gradient is not smooth because it is performed by a straight blade. In addition, the presence of the double bevel, which is classic for a razor blade, causes the hair to be cut off giving a serrated or, otherwise, non-smooth cut of the lock. The double bevel, in fact, pushes some hair to the cut while the remaining part are kept inside the lock. In the blade guide on the lock, therefore, the hair is cut at length giving the serrated or stepped effect instead of the smooth one.

Moreover, both the described techniques have a high risk of ruining hair, curling it at the tips, damaging it and favoring the formation of split ends.

Moreover, both razors and scissors force the operator to keep the wrist in non-natural positions for a long time and to move it in a complicated manner, promoting fatigue to the joint as well as the onset of long-term medical problems.

PRESENTATION OF THE INVENTION

Object of the present invention is to overcome, at least partially, the drawbacks outlined above by providing a hair cutting tool which allows the execution of cuts giving a smooth shaping, i.e. without undesired steps.

In particular, an object of the present invention is to provide a hair cutting tool that allows the execution of cuts with non-serrated curved lines.

In this sense, another object is that this hair cutting tool self-convey the lock to be cut towards the cutting wire.

A further object is to provide a hair cutting tool that progressively guides the cutting outwards of the lock so as to ensure a continuous, smooth, non-serrated curvilinear cut.

Said objects, as well as others which will be better understood below, are achieved by a hair cutting tool according to one or more of the following claims which are an integral part of the present patent.

In particular, the hair cutting tool comprises a shaped supporting body for the handle by a user and it is provided with a gripping element of laminar bodies.

It also includes a cutting blade having, as known blades, a laminar body provided with a cutting edge. Such body is thus suitable to be gripped by the gripping element of the shaped body.

However, the cutting blade of the tool of the invention is of the single bevel type and, according to an aspect of the invention, the cutting edge has a concave development line towards the inside of the laminar body.

In other words, the cutting blade of the invention has the curvilinear cutting edge curved towards the inside of the laminar body.

Advantageously, therefore, such conformation allows for the automatic conveying of the lock to be cut towards the cutting edge. However, the curvilinear shape allows for a step-free cut, i.e. a smooth and gradual cut from the outside towards the inside of the lock.

Moreover, the single bevel avoids the cut off of the hair by pushing advantageously the blade inside the lock with a gradual and continuous effect.

According to another aspect of the invention, the laminar body has at least one bulged portion having a perimeter section comprising the cutting edge. Moreover, according to a further aspect of the invention, the convexity defines, for this portion of the laminar body, a concave surface and an opposite convex surface on which the bevel is made.

Advantageously, therefore, the cutting blade has a second curvature, besides that of the cutting edge, consisting of the curvature of at least one portion of the laminar body comprising the cutting edge itself. Consequently, the cutting blade takes a substantially spoon-like shape at least in a perimeter of the cutting edge of the blade.

This allows the blade to independently direct the cut towards the outside of the object to be cut compensating for the effect of the single bevel and favoring the execution of curvilinear cuts without steps. These curved cuts are easy to execute since they are favored by the shape of the blade itself.

In this respect, however, it is noted that the bevel being performed on the convex surface of the laminar body exacerbates these effects and also allows, advantageously, to protect the user's hands more effectively.

On the basis of what has been said, it is obvious that said objects are also achieved by a cutting blade having a laminar body provided with a single bevel and a cutting edge. This blade is characterized in that the cutting edge has a concave development line and in that the laminar body has at least one bulged portion having a section of the perimeter comprising the cutting edge, the bulged portion defining for that portion of the laminar body a concave surface and the opposite surface convex on which the bevel is realized.

BRIEF DESCRIPTION OF THE DRAWINGS

Further features and advantages of the invention will be more evident in light of the detailed description of a preferred but not exclusive embodiments of a cutting hair tool according to the invention illustrated by way of non-limiting example with the aid of the accompanying drawings, wherein.

DETAILED DESCRIPTION OF SOME PREFERRED EMBODIMENT EXAMPLE

Figure 1:
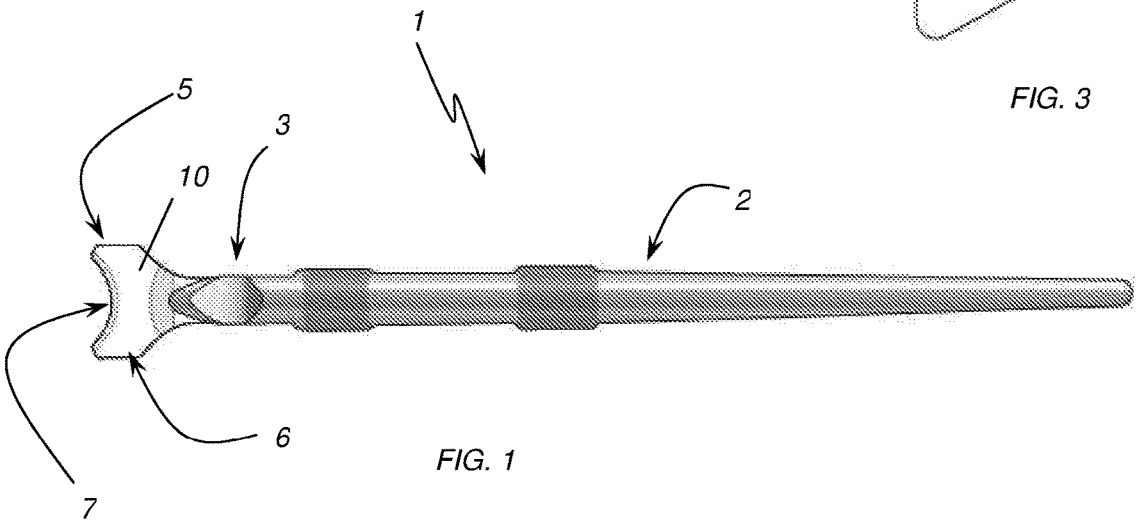
FIG. 1 represents a front view of a cutting tool according to the invention.

With reference to the above-mentioned figures, and in particular to FIG. 1, a hair cutting tool 1 is described.

It comprises a shaped, supporting body 2 for the handle by a user and it is provided with a gripping element 3 of laminar bodies.

In the figure, the shaped support 2 has a substantially rectilinear shape having predominantly a longitudinal development. However, it is evident that such shaping is not intended to be restricting for the invention since it can be any shape.

According to an aspect of the invention, the hair cutting tool 1 also includes a cutting blade 5 having, as known blades, a laminar body 6 provided with a cutting edge 7.

Figure 2:
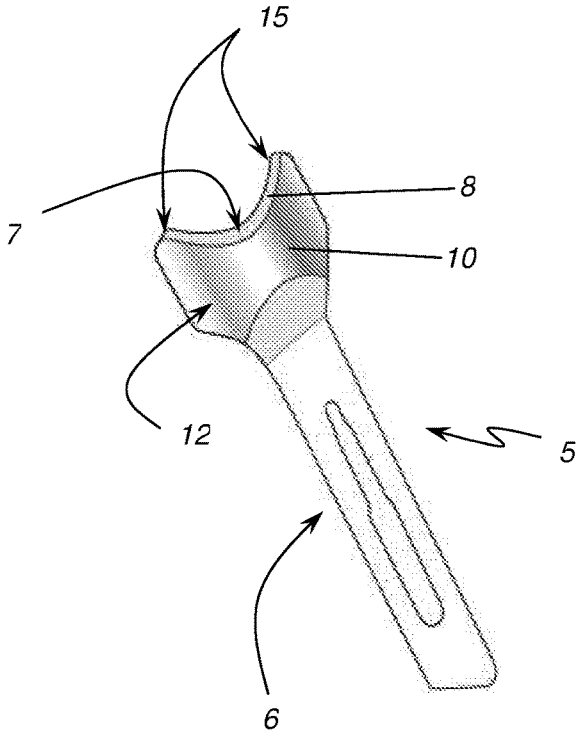
FIG. 2 represents a perspective view of a cutting blade according to the invention.
Figure 3:
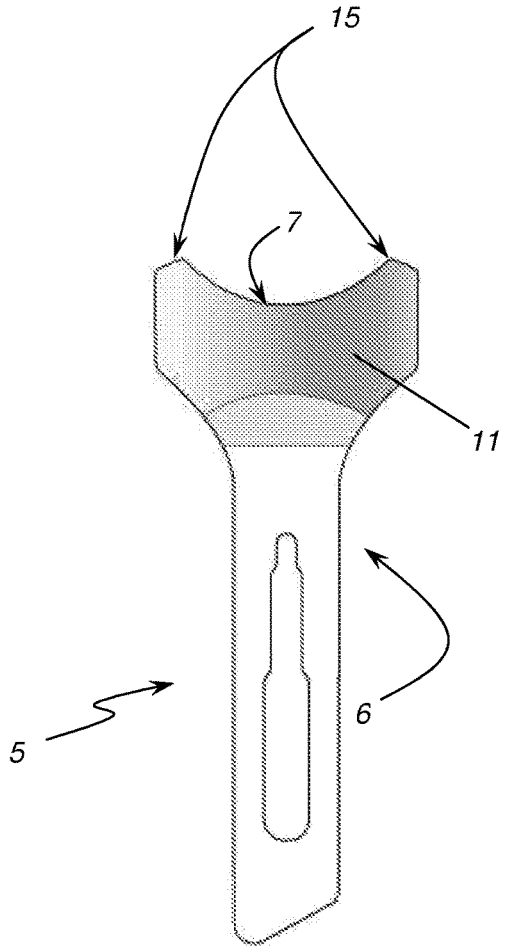
FIG. 3 represents a front view of the blade of FIG. 2.

As can be seen in the details of FIGS. 2 and 3, according to an aspect of the invention, the cutting blade 5 is of the single bevel 8 type so as to make a kind of a chisel.

According to another aspect of the invention, the cutting edge 7 has a concave development line. In other words, the cutting edge 7 is concave having a curve shaped with the curvature radius facing the inside of the laminar body 6.

Advantageously, as said in the presentation of the invention, such a conformation allows for the automatic conveying of the lock to be cut towards the cutting edge 7. In other words, with the hair cutting tool 1, the lock is guided from the curvature of the cutting edge 7 towards the center of the same.

However, the curvilinear shape of the cutting edge 7 allows for a stepped-free cut, i.e. a smooth and gradual cut since the cut moves gradually from the outer portions of the lock towards the inner portions. In other words, the cut occurs from the outer hair of the lock, gradually moving towards the inner one, resulting in a curved shaped cut and no longer a pointed one. However, in the known art, since typically we use scissors that generate a V-shaped overall cutting edge, the cut is straight, and it shapes the lock like a V.

About the single bevel 8, it is performed, as it is obvious and as can be seen in FIGS. 2 and 3, only on a first surface 10 of the blade 5. Such an essentially chisel-like conformation of the blade 5 itself advantageously allows guiding the cutting of the hair towards the hair arranged on the side of the blade 5 corresponding to the second surface 11 opposite to the first one 10 and having no bevel. This happens in a continuous and gradual way, avoiding the shearing off of the hair and its stepping.

Moreover, the chisel-like shape of the blade 5 makes it possible to achieve a gradual and sharp cut. In case of hair, this avoids having it ruined or damaged and, in particular, the formation of split ends is then avoided.

According to another aspect of the invention, the laminar body 6 has a bulged portion 12 whose perimeter, for a section, consists of the cutting edge 7.

More in detail, the convexity is such to define for that portion 12 a concave surface, corresponding to the second surface 11 of the blade 5 and the opposite surface, i.e., the first convex shaped surface 10.

Advantageously, therefore, the cutting blade 5 has a second curvature, besides that of the cutting edge 7, consisting of the curvature of at least one portion 12 of the laminar body 6 comprising the cutting edge 7 itself. Consequently, the cutting blade 5 takes a substantially spoon-like shape at least in a perimeter of the cutting edge 7 of the blade 5.

This also favors the conveying of the object to be cut towards the cutting edge 7 especially in case of soft objects such as hair. Moreover, this allows for a further special advantage. Since, as said, the single bevel 8 tends to guide the cutting blade 5 towards the inside of the lock, the convexity allows to compensate for such phenomenon, guiding the blade 5 towards the outside of the lock. This results in a curvilinear cut in the center of the lock oriented to come out of it. Such cut is smooth and continuous without forcing the user to move the handle in a strange way to perform it.

This results, advantageously, in a double curvature of the laminar body 6 and of the cutting edge 7 which allows a gradual and continuous (i.e. step-free) cut of the lock both from its edge towards the inner part and from its front towards the back. In other words, advantageously, a lock with an appreciable volume has a smoothed cut in both the development axes of the section.

Obviously, also the user has an advantage since his hands are more protected.

In this respect, however, according to a further aspect of the invention the ends 15 of the cutting edge 7 are rounded.

It is evident that the limitation of the convexity to a single portion 12 of the laminar body should not be considered a limitation for the scope of protection of the present invention since it refers only to the embodiment of the invention being disclosed. In fact, according to a non-represented variant embodiment, but, anyway, falling within the scope of protection of the present invention, the whole laminar body is bulged.

However, it is evident that the object of the invention is also a cutting blade 5 as described above.

It therefore comprises a laminar body 6 provided with a single bevel 8 and a cutting edge 7.

According to an aspect of the invention, the cutting edge 7 has a concave development line, while the laminar body 6 has a bulged portion 12 having the cutting edge 7 which constitutes a perimeter section.

Furthermore, the convexity defines for such portion 10 of the laminar body 6 a concave surface 11 and the opposite convex surface 12 on which the bevel 8 is realized.

A detailed description of the cutting blade 5 is omitted here, since it replicates what is said for the hair cutting tool 1 of the invention.

What is to be noted and highlighted are the operating advantages of the hair cutting tool 1 performed in this way.

In particular, many hair cutting operations, such as the razor cut, are facilitated and have a better effect. While in the known art either a scissor with V-shaped open blades or normal razors are used with all the disadvantages highlighted above, in the case of the hair cutting tool 1 of the invention, the cutting blade 5 allows smooth shades and a sharply improved overall effect while maintaining the quality of the hair.

However, a major operational aspect is the fact that the handle of the hair cutting tool 1 used to make those cuts is in a natural position, and it does not force the operator to bend the wrist painfully as in the case of scissors use. Even in the case of razors used to obtain curved shapes, the wrist is kept and moved unnaturally. In the case of the hair cutting tool 1 of the invention, however, the movement of the wrist is substantially exclusively curvilinear with the concavity of the movement corresponding to the concavity of the shades to be obtained.

If, furthermore, the user wanted to reverse the concavity of the cut, it is sufficient to rotate the cutting tool 1 by 180° without subjecting the wrist to be subject to difficult and tiring movements, since they are protracted and repeated for hours.

In light of the above, it is to be understood that the hair cutting tool of the invention overcomes the drawbacks of the known art, allowing the execution of cuts giving a smooth shaping, i.e. without undesired stepping.

Specifically, it allows cuts with non-serrated curved lines and is designed to self-convey the lock to be cut towards the cutting wire.

The cut is also guided naturally and gradually towards the outside of the lock and not towards the inside.

The hair cutting tool of the invention is susceptible of numerous modifications and variations, all of which fall within the inventive concept expressed in the attached claims. All the details may furthermore be replaced by other technically equivalent elements, and the materials may be different depending on the needs, without departing from the scope of the invention.

Although the hair cutting tool of the invention has been described with particular reference to the accompanying figures, the reference numbers used in the description and claims are used to improve the intelligence of the invention and do not constitute any limitation to the claimed scope of protection.

The invention claimed is:

1. A hair cutting tool comprising:

a shaped supporting body adapted for use as a handle by a user and provided with a gripping element for laminar bodies; and a cutting blade having a laminar body provided with a single bevel and a cutting edge that defines a concave development line toward an inside of said laminar body in a direction of said supporting body, wherein said laminar body of said cutting blade has at least one curved portion having a perimeter section comprising said cutting edge, and wherein said curved portion defines a concave surface for said curved portion of said laminar body, said single bevel being provided on an opposite convex surface.

2. The hair cutting tool according to claim 1, wherein ends of said cutting edge of said cutting blade are rounded.

3. A cutting blade having a laminar body comprising:

a single bevel; and a cutting edge, wherein:

said cutting edge has a concave development line in a longitudinal direction of said cutting blade; and said laminar body has at least one curved portion having a perimeter section comprising said cutting edge, said curved portion defining a concave surface for said curved portion of said laminar body, said bevel being provided on an opposite convex surface.

4. The cutting blade according to claim 3, wherein ends of said cutting edge are rounded.

* * * * *